United States Patent [19]

Meyer

[11] Patent Number: 4,643,109

[45] Date of Patent: Feb. 17, 1987

[54] GASIFICATION OF COAL

[75] Inventor: Philippus J. Meyer, Secunda, South Africa

[73] Assignee: Sasol Operations (Proprietary) Limited, Johannesburg, South Africa

[21] Appl. No.: 802,033

[22] Filed: Nov. 26, 1985

[30] Foreign Application Priority Data

Nov. 27, 1984 [ZA] South Africa ..... 84/9260

[51] Int. Cl.[4] ..... F23G 5/12

[52] U.S. Cl. ..... 110/229; 48/77; 48/86 R; 110/108; 110/256

[58] Field of Search ..... 110/229, 108, 256; 48/77, 67, 86 R, 10, 210

[56] References Cited

U.S. PATENT DOCUMENTS

| | | | |
|---|---|---|---|
| 4,033,730 | 7/1977 | Baron et al. | 110/108 X |
| 4,165,970 | 8/1979 | Rudolph et al. | 110/229 X |
| 4,538,528 | 9/1985 | Faehnle | 110/229 |

FOREIGN PATENT DOCUMENTS

| | | | |
|---|---|---|---|
| 94220 | 9/1923 | Austria | 48/86 R |
| 0059991 | 9/1982 | European Pat. Off. . | |
| 203144 | 9/1923 | United Kingdom . | |
| 216488 | 4/1925 | United Kingdom . | |
| 337721 | 11/1930 | United Kingdom . | |
| 439562 | 12/1935 | United Kingdom . | |
| 668702 | 3/1952 | United Kingdom . | |
| 720775 | 12/1954 | United Kingdom . | |
| 810928 | 3/1959 | United Kingdom . | |
| 841670 | 7/1960 | United Kingdom . | |
| 1203876 | 9/1970 | United Kingdom . | |

*Primary Examiner*—Edward G. Favors

*Attorney, Agent, or Firm*—Dressler, Goldsmith, Shore, Sutker & Milnamow

[57] ABSTRACT

A fixed bed dry bottom coal gasifier has a cylindrical wall providing a gasification chamber for gasifying coal to produce synthesis gas. It also has a coal lock above the chamber. The coal lock has a coal discharge opening leading into the chamber. A gas outlet leads from the chamber at a high level. The gasifier further includes a first static coal distributor located in the gasification chamber below the coal discharge opening of the coal lock and a second static coal distributor located below the first coal distributor. The first coal distributor has an upper opening spaced with vertical clearance from the coal discharge opening, a lower opening spaced from the upper opening, and an upwardly directed peripheral coal distributing surface flaring downwardly outwardly from said upper opening and extending beyond the vertical projection of the periphery defining the coal discharge opening. The second coal distributor also has an upper opening and a lower opening, its upper opening being spaced with vertical clearance from the lower opening of the first distributor. The second distributor has a passageway extending from its upper to its lower opening through which coal can be distributed into the space below the first distributor.

14 Claims, 4 Drawing Figures

GASIFICATION OF COAL

FIELD OF THE INVENTION

This invention relates to the gasification of coal. It relates in particular to a coal gasifier, and to a coal distribution device for a coal gasifier.

SUMMARY OF THE INVENTION

According to a first aspect of the invention, there is provided a fixed bed dry bottom coal gassifier having a cylindrical wall providing a gasification chamber for gasifying coal in a coal bed to produce synthesis gas as well as to produce ash in an ash bed below the coal bed, a coal lock above the chamber and having a more-or-less centrally located coal discharge opening leading into the chamber, a gas outlet leading from the chamber at a high level, an ash discharge outlet leading from the chamber at a low level, and discharge means for discharging ash from the chamber via the ash discharge outlet, the gasifier including a first coal distributor located in the gasification chamber below the coal discharge opening of the coal lock, and a second coal distributor located below the first coal distributor and spaced with clearance therefrom, the second coal distributor adapted to distribute coal passing from the first coal distributor into the space below the first distributor.

The coal discharge opening of the coal lock may be circular. The first coal distributor may be of a hollow open-ended frusto-conical shape with its smaller opening being directed upwardly.

The diameter of the smaller opening of the first coal distributor may be substantially the same as that of the coal discharge opening, and may be aligned therewith. The gasifier may include a circular disc-like closure member movable downwardly from a first position in which it closes off the coal discharge opening of the coal lock to a second position in which it is spaced with clearance from said opening, so that coal can then be discharged from the coal lock. The closure member, in the second position, may also close off the smaller upper opening of the first distributor. In other words, the distance which the top or upper end of, or the smaller opening of, the first distributor is located below the coal lock discharge opening is substantially the same as the travel of the closure member from its first to its second position.

The gasifier may be a LURGI (trade name) gasifier, in which the ash discharge means is in the form of a circular (when seen in plan view) grate mounted to rotate above the ash outlet, and in which the ash outlet is an annular outlet.

The second coal distributor may also be of hollow open-ended frusto-conical shape, with its smaller opening being directed upwardly. The diameter of the upper opening of the second distributor may be smaller than the diameter of the bottom or larger opening of the first coal distributor. The top of the second coal distributor may be so spaced from the bottom of the first coal distributor that no bridging will take place in the coal flow down the gasification chamber.

The heights of the first and second coal distributors and their spacing from each other is such that the bottom of the second distributor is located below the coal bed level in the gasification chamber.

The second coal distributor may comprise an upper and a lower section located below the upper section.

The upper section may be attached to a wall of the chamber, and the first coal distributor may be connected to the upper section, thereby locating the first distributor in position in the chamber. The connection of the upper section of the second distributor to the first distributor may be effected by means of a plurality of circumferentially spaced connectors extending between the upper section and the first distributor. The attachment of the upper section to the wall of the chamber may be effected by means of lugs extending between at least some of the connectors and the chamber wall. The chamber wall may comprise outer and inner skins spaced apart so that a cavity is provided between them, the cavity containing water so that the inner skin and the water-filled cavity constitute a water jacket along the inside of the outer skin.

The lower section may also be attached to the wall of the chamber. The attachment of the lower section of the second coal distributor to the wall may be effected by means of a plurality of attachment means extending between it and the wall. The attachment means may be spaced apart circumferentially about the lower section.

The ratio of the diameter of the upper opening of the first distributor to that of its lower opening may be between 1:1,4 and 1:2,5, typically between 1:1,6 and 1:2,0. Similarly, the ratio of the diameter of the upper opening of the upper section of the second distributor to that of its lower opening, as well as the ratio of the diameter of the upper opening of the lower section of the second distributor to that of its lower opening, may be between 1:1,4 and 1:2,5, typically between 1:1,6 and 1:2,0.

The spacing between the first and second distributors may be at least 0,5 m, typically between 0,5 and 1,5 m.

The ratio of the height of the first distributor to that of the second distributor may be between 1:1 and 1:10, typically between 1:2 and 1:8. The ratio of the height of the upper section of the second distributor to that of its lower section may be between 1:0,5 and 1:5, typically between 1:1 and 1:3.

In one embodiment of the invention, the gasifier may include an annular skirt depending downwardly from a portion of the chamber wall which is at a higher level than the gas outlet, so that an annular gas-collecting zone is defined between the skirt and a lower portion of the gasification chamber wall, with the gas outlet leading through this portion of the wall, the skirt surrounding at least part of the coal distributor. The skirt may be spaced radially from the coal distributor so that it is spaced with clearance from the distributor. The skirt, at or near its lower or bottom peripheral end, may taper downwardly inwardly so that its diameter at its lower end is smaller than that at its upper end.

In another embodiment of the invention, the gasifier may include separating means separating the inside of the upper and/or lower sections of the second coal distributor into a coal-containing zone and a gas-collecting zone, the gas outlet then leading from the gas-collecting zone. The separating means may include a vertically downwardly depending annular skirt attached to and depending from the inner surface of the lower section of the second coal distributor so that the gas-collecting zone is an annular zone located between the skirt and that portion of the lower section of the second coal distributor located below the zone of attachment of the skirt to the section. The gas outlet may comprise a conduit extending through said portion of the lower section of the second coal distributor and through the wall of the gasification chamber. A water jacket may be provided around at least a portion of this conduit.

The gasifier may include a tar injection outlet leading through the chamber wall so that an outlet or discharge opening of the conduit is located within the first coal distributor.

According to a second aspect of the invention, there is provided a coal distribution device for a fixed bed dry bottom coal gasifier having a cylindrical wall providing a gasification chamber for gasifying coal in in a coal bed to produce synthesis gas and to produce ash in an ash bed below the coal bed, a coal lock above the chamber and having a more-or-less centrally located coal discharge opening leading into the chamber, a gas outlet leading from the chamber at a high level, an ash discharge outlet leading from the chamber at a low level, and discharge means for discharging ash from the chamber via the ash discharge outlet, the device including

- a first hollow open-ended frusto-conically shaped coal distributor;
- a second hollow open ended frusto-conically shaped coal distributor spaced from, and aligned with, the first coal distributor so that its smaller opening faces the larger opening of the first coal distributor;
- connecting means for interconnecting the distributors; and
- attachment means for attaching the first and/or second coal distributor to a wall of a gasification chamber.

As mentioned hereinbefore, the smaller opening, or top of, the second distributor may be spaced at least 0,5 m from the larger opening, or bottom end, of the first coal distributor. The second coal distributor may comprise first and second hollow open-ended frusto-conical sections adjacent and co-axial with one another, the smaller opening of the second section facing the larger opening of the first section. The diameter of the smaller opening of the lower section of the second coal distributor may be about the same as, or slightly smaller than, that of the larger opening of the first coal distributor. Hence, the diameter of the lower opening of the second section of the second distributor will be greater than that of the lower opening of the first distributor.

BRIEF DESCRIPTION OF THE DRAWINGS

The invention will now be described by way of example with reference to the accompanying diagrammatic drawings.

In the drawings.

DESCRIPTION OF THE PREFERRED EMBODIMENTS

Figure 1:
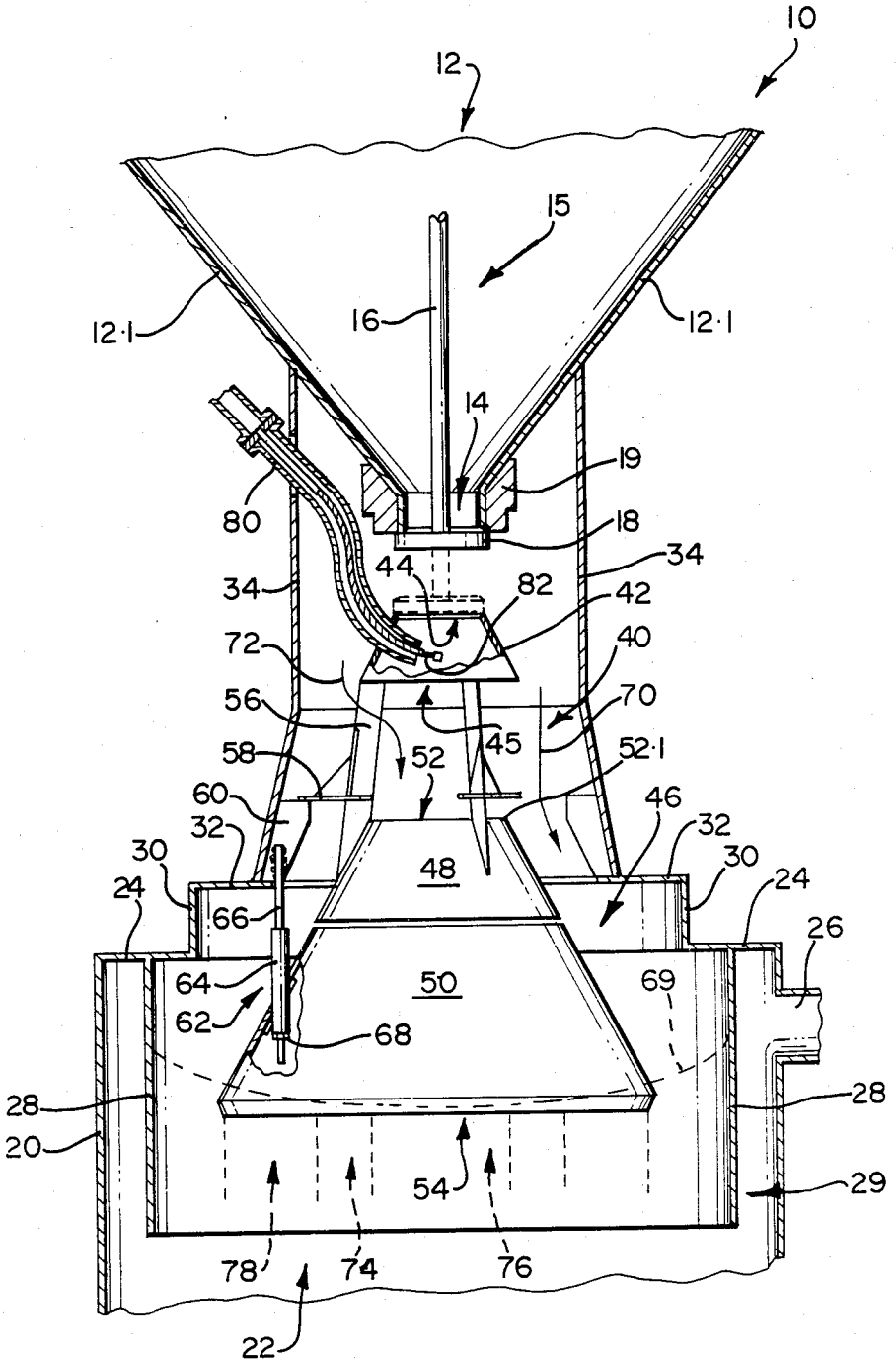
FIG. 1 shows, in part, a longitudinal or vertical sectional view of a fixed-bed dry-bottom coal gasifier according to one embodiment of the invention, its coal distribution dvice being generally shown infull with parts thereof only cut away for clarity.

Referring to FIG. 1, reference numeral 10 generally indicates a fixed-bed dry-bottom coal gasifier according to one embodiment of the invention.

The gasifier 10 includes a coal lock 12, having a bottom 12.1 which tapers radially inwardly and downwardly towards a circular coal discharge opening 14. The coal lock 12 includes closure means, generally indicated by reference numeral 15, for closing off the opening 14. The closure means 15 comprises a rod or shaft 16 to the bottom end of which is fitted a circular disc-like closure member 18. The gasifier 10 also includes actuating means (not shown), connected to the rod 16 for displacing the rod axially from a closed position as indicated in the drawing and in which the closure member 18 closes off the opening 14, to an open position (indicated in broken line in the drawing), in which coal (not shown) can be discharged from the coal lock 12. A strengthening ring 19 is provided around the opening 14.

The gasifier 10 also includes a round cylindrical wall 20 defining a gasification chamber 22. It is to be understood that the wall 20 constitutes the inner wall of a double-walled construction (not shown) comprising an inner wall and an outer wall spaced from the inner wall, so that the two walls between them define a cavity which is filled with water. In other words, the pair of walls and the water-filled cavity constitute a water jacket. The top end of the chamber is partly closed off by means of an annular closure member 24, and a radially outwardly extending gas outlet passageway 26 leads from the chamber 22, near the upper end of the gasifier.

An annular or circular skirt 28 extends downwardly from the closure member 24, and the gasifier includes a round ring-like portion 30 extending upwardly from the member 24. A further annular closure member 32 extends radially inwardly from the portion 30, and a round cylindrical member 34 extends between the closure member 32 and the funnel-like bottom or base 12.1 of the coal lock. The member 34 flares downwardly outwardly near its lower end, ie near the end which is attached to the closure member 32.

The gasifier 10 further includes a coal distribution device, located within the chamber 22, and generally indicated by reference numeral 40.

The coal distribution device 40 includes a first hollow frusto-conical coal distributor 42 located immediately below the outlet opening 14 of the coal lock 12. The spacing of the distributor 42 from the opening 14 is such that when the closure member 18 is in its open or lowermost position, it closes off the upper opening 44 of the distibutor 42. Hence, the diameter of the opening 44 is more-or-less the same as that of the closure member 18. The diameter of the opening 44 may be about 0,5 m, and that of the lower opening 45 of the distributor 42, about 0,9 m. The height of the distributor 42 may be about 0,35 m.

The coal distribution device 40 also includes a second coal distributor, generally indicated by reference numeral 46, spaced axially from, and aligned with, the distributor 42. The distributor 46 comprises two hollow open-ended frusto-conical sections 48 and 50 located adjacent each other, with the section 48 being located above the section 50. The diameter of the upper opening 52 of the section 48 is slightly smaller than the diameter of the lower opening 45 of the distributor 42.

The diameter of the upper opening 52 of the section 48 may be about 0,8 m, and that of its lower opening about 1,4 m. The diameter of the upper opening of the section 50 may be about 1,4 m, and that of its lower opening 54 about 2,5 m. The height of the section 48 may be about 0,5 m, and that of the section 50 about 1 m. The distance between the opening 54 of the distributor 42 and the opening 52 of the distributor 46 may be about 0,7 m.

Hence, the distributors 42, 46 taper upwardly inwardly at an angle of about 60° to the horizontal, and the total length or height of the distribution device 40 may be about 2,6 m.

The coal distribution device 40 further includes a plurality of axially extending, circumferentially spaced, connecting members 56 interconnecting the distributor 42 and the section 48 of the distributor 46. Each of the connecting members 56 is provided with attachment means in the form of a radially outwardly extending lugs or support plate 58, which rests on and is attached to (not shown) supports 60 extending radially inwardly from the member 34.

The distribution device 40 also includes a plurality of elongate axially extending, circumferentially spaced, attachment means, each generally indicated by reference numeral 62 (only one of which is shown—typically six may be provided, the others having been omitted for clarity), for the section 50. Each of the attachment means 62 comprises a round hollow cylindrical member or sleeve 64 extending through an aperture in the section 50, and attached thereto, for example by being welded thereto. A screw-threaded rod or bar 66 passes through the member 64. The upper end of the rod 66 is attached to one of the supports 60, for example, by being welded thereto. A nut and plate assembly 68 is screwed onto the lower end of the rod 66, so that the section 50 is thereby located in position below the section 48.

The gasifier 10 still further includes an injection pipe 80 extending through the member 34 and through the distributor 42, and having a nozzle 82 within the distributor 42. A tar/fine coal mixture, which is an undesirable by-product produced during the gasification of coal, is separated from other products formed during the gasification process in downstream processing plant (not shown) and is then fed through the pipe 80 and the nozzle 82, back into the gasifier where it is re-gasified. The location of the nozzle 82 permits the the tar/fine coal mixture to be sprayed onto a more or less horizontal bed of coal moving down the member 34 which, Applicant believes, will give more effective distribution of the tar.

In use, the outlet opening 14 of the coal lock 12 is opened by moving the rod and closure member 18 axially from the first to the second position when the top of the coal bed (not shown) in the chamber 20 is approximately at the level indicated by the broken line 69. The bottom opening 54 of the coal distributor 46 is then still located within the coal bed. The coal (not shown) discharged from the coal lock 12 will initially fall into the annular space around the outside of the coal distribution device 40 (e.g. as indicated by the arrow 70) until the top of the coal bed is more or less at the same level as the top opening 52 in the section 48 of the coal distributor 46.

The Applicant believes that very little segregation of the coal into coarse and fine fractions will occur while said annular space is being filled up. Hence, the coal located in the annular section around the distributor 46, should contain a more or less homogeneous mix of coarse and fine coal.

When the top of the coal bed reaches approximately the same level as the top of the section 48 of the distributor 46, futher coal added via the coal lock 12 will then flow or fall into the space between the bottom of the distributor 42 and the top of the section 48, and through the upper opening 52 in the section 48, thereby filling the distributor 46. The Applicant believes that if any segregation of the coal into finer and coarse fractions takes place within the distributor 46, it will, as a result of the flow properties of comminuted or pulverized coal take place in the following fashion: Immediately below the upper edge 52.1, i.e. the periphery of the opening 52, of the section 48 an annulus 74 of finer coal will be found. In the centre of this annulus there will be a core 76 of coarser coal, and around the outside of the annulus 74 there will be a further annulus 78 also comprising coarser particles of coal.

The Applicant has found that with conventional fixed-bed dry bottom LURGI (trade name) gasifiers, i.e. LURGI (trade name) gasifiers not provided with a coal distribution device, segregation of the pulverised or comminuted coal into coarser and finer fractions, is experienced. This problem is brought about when the coal is dumped into the gasification chamber from the coal lock during the normal loading cycle of the gasifier, the coal hence free-falling some distance into the gasification chamber.

In particular, the Applicant has found that when pulverised or comminuted coal, having a normal particle size distribution, is allowed to free-fall for a distance before it comes to rest in or on a coal bed, then larger or coarser coal particles tend to accumulate around the wall of the chamber, hence also below the gas outlet 26, while the finer particles tend to accumulate at the center of the chamber. During subsequent gasification of the coal by means of a gasifying agent in the form of a mixture of steam and oxygen, the coal bed moves slowly downwardly towards a fire-bed located at a lower level. The gasifying agent, which enters the gasification chamber at or near its bottom via outlet or discharge openings in a circular rotating grate (not shown) located in the bottom of the gasification chamber below the fire-bed and above an ash discharge outlet (not shown) in its bottom tends to follow an upwardly extending path of least resistance through the coal bed, i.e. it passes preferentially through the coarser coal particles. The inner surfaces of the inner wall of the gasification chamber, which is usually fairly smooth, contribute to this problem. Hence, coal combustion is enhanced in the region of the inner walls of the chamber. The Applicant has found that this leads to overheating of, and subsequent damage to, the jacket wall; poor gasifier operation, especially if the coal contains a large proportion of fines; damaged grate ploughs due to overheating, etc.

On its passage through the coal bed, the gasifying agent reacts with the coal to form raw gas which exits the chamber via the outlet 26. The coarse coal fraction which accumulates along the periphery of the chamber acts as filter for knocking out fine coal entrained in the gas.

The Applicant beleives that the more uniform the particle size distribution throughout the gasifier, the better the control of the gasifier operation can be. In particular, its believes that more stable gasifier operation and higher gasifier loadings should be obtainable if a more consistent fire-bed, i.e. more uniform coal particle size distribution, in the gasification chamber can be obtained. Damage to the jacket wall, due to exceptionally high temperatures, can also possibly be reduced as a result.

The Applicant further believes that, with the coal distribution device 40,

- homogeneous coal particle distribution within the coal gasifier, it approached, in that the core 76 of the coal-bed in the gasifier comprises relatively coarse coal particles;
- the fines are spread more evenly throughout the coal bed; and
- the coal fraction adjacent the wall 20 is a mix of fine and coarse coal particles.

Hence, the Applicant believes that the gasifier 10 will have the following advantages over conventional fixed-bed dry bottom LURGI (trade name) gasifiers not fitted with the coal distribution device 40:

- a more homogeneous particle size distribution of coal in the coal bed;
- more stable gasifier operation;
- lower gas outlet temperatures;
- less damage to the inner jacket wall due to overheating;
- longer on-steam times, since there is less damage to the jacket wall; and
- more effective distribution of the tar/fine coal mixture injected via the pipe 80.

Furthermore, the device 40 does not have any moving parts which are usually prone to problems, and it should have relatively low capital, installation and maintenance costs.

The Applicant still further believes that when a coal distribution device 40 is installed into a existing fixed-bed dry bottom LURGI (trade name) gasifier, the gasifying agent distribution pattern, i.e. the pattern of the gasifying agent nozzles or discharge openings provided in the grate, may need to be modified to take into account the distribution device 40. Failure to do so may result in excessive gasification along the centre-line or axis of the gasification chamber, where a relatively coarse coal fraction will now accumulate.

The primary purpose of the skirt 28 is to prevent coal located on the inside thereof from being carried over the outlet 26. The raw gas collects in the annular gas-collecting zone 29 between the skirt 28 and the wall 20, before exiting via the outlet 26.

The velocity of the gas passing through the annular gas-collection zone 29 is directly dependent on the gasifier gas load, ie the volume of gas produced per unit time in the gasifier. As a result of the velocity of the gas emerging from the top of the bed, there is usually a degree of entrainment of coal, especially fines, in the gas, which is then 'lost' via the gas outlet 26. As mentioned hereinbefore, with the coal distribution device 40 segregation of the coal into coarser and finer zones is overcome to a large extent, and hence a larger proportion of fine coal particles and fragments are located along the periphery of the chamber. These may possibly hence be entrained in the gas. Furthermore, as a result of the higher gas loads obtainable with the device 40, there could possibly be an increased amount of fine coal carry-over with the gas exiting from the gasifier, depending on operating parameters.

The Applicant believes that such carry-over can at least be reduced by reducing the gas velocity in the region in which the gas leaves the coal bed, ie at the coal bed/gas interface. This can be accomplished, for example, with the gasifier arrangements indicated in FIGS. 2, 3 and 4, which are described in more detail hereunder.

Figure 2:
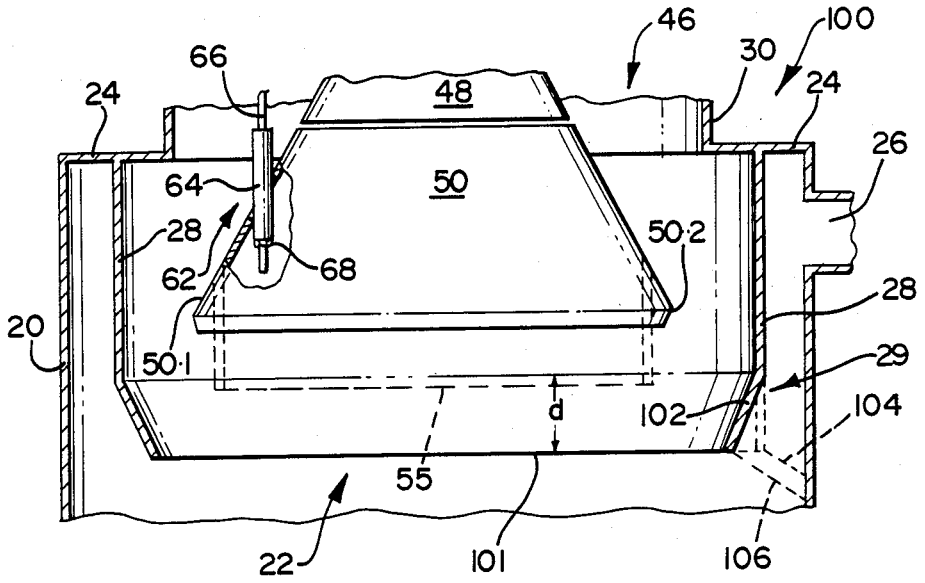
FIG. 2 shows, in part, a longitudinal sectional view of a fixed-bed dry-bottom coal gasifier according to another embodiment of the invention, the second section of its second coal distributor being generally shown in full with parts thereof only cut away for clarity.

Referring to FIG. 2, reference numeral 100 generally indicates a fixed-bed dry-bottom coal gasifier according to another embodiment of the invention.

Parts of the gasifier 100 which are similar to those of the gasifier 10 hereinbefore described with reference to FIG. 1, are indicated with the same reference numerals.

A lower portion 102 of the skirt 28 of the gasifier 100 tapers downwardly inwardly towards its lower end 101. Hence, the diameter of the skirt 28 is smaller at its lower end 101 than at its upper end.

With the skirt 28 of the gasifier 10 hereinbefore described with reference to FIG. 1 (the skirt 28 also being indicated in broken line in FIG. 2), the normal coal bed upper level or coal bed/gas interface is indicated in broken line by reference numeral 104.

The velocity of the gas, and hence the degree of fines entrainment, entering the annular zone 29, ie at the interface, is determined by the surface area of the coal bed at this interface. By flaring the portion 102 inwardly (the portion 102 extending up a distance 'd' of about 0,5 meter), the area of the interface, as indicated by reference numeral 106, is increased substantially, resulting in lower gas velocities at the interface. The Applicant believes that this will lead to reduced entrainment of coal fines in the gas.

If desired, a round cylindrical skirt 55 as indicated in broken line, may be attached to the inside of the lower section 50 so that it depends downwardly from the section 50. If further desired, the portion 50.2 of the section 50 may then be cut away (not shown) to increase the distance between it and the skirt 28, e.g. to avoid coal bridging as far as possible.

Figure 3:
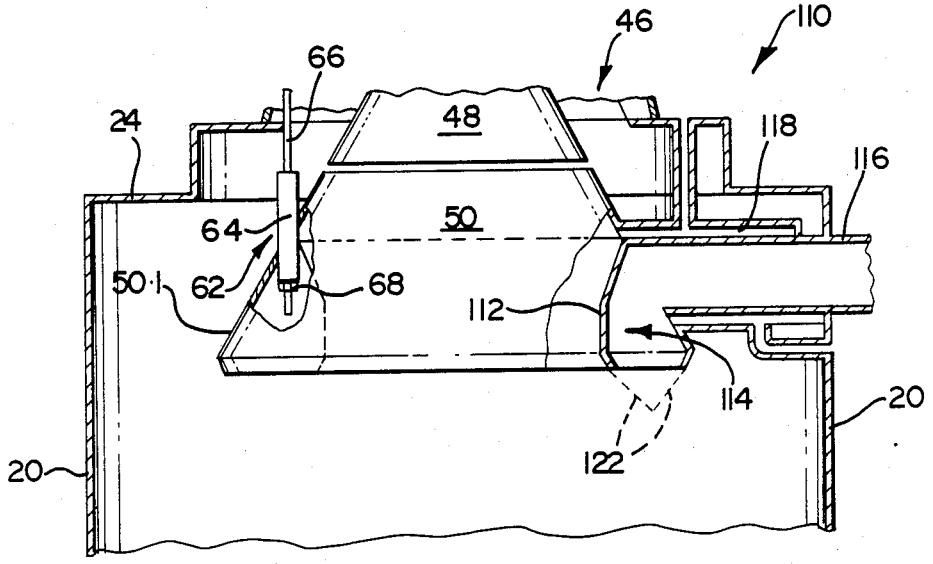
FIG. 3 shows, in part, a longitudinal sectional view of a fixed-bed dry-bottom coal gasifier according to yet another embodiment of the invention, the second section of its second coal distributor being generally shown in full with parts thereof only cut away for clarity.

Referring to FIG. 3, reference numeral 110 generally indicates a fixed-bed dry-bottom gasifier according to another embodiment of the invention.

Parts of the coal gasifier 110 which are similar to those of the gasifier 10 hereinbefore described with reference to FIG. 1, are indicated with the same reference numerals.

In the gasifier 110, the skirt 28 has been disposed with.

The gasifier 110 instead includes a circular or annular skirt 112. The skirt 112 is located inside the lower section 50 of the coal distributor 46 and is attached to the inside of the section 50. Hence, an annular gas-collecting zone 114 is defined between the skirt 112 and the inside of the lower portion 50.1 of the section 50.

A gas outlet conduit 116 extends radially outwardly from the lower portion 50.1 through the wall 20 of the gasifier. A water jacket 118 is located around the conduit 116 to protect it.

With this arrangement, the normal coal bed/gas interface of a fixed-bed dry bottom gasifier not provided with the skirt 112, ie provided with the skirt 28, as shown by the broken line 104 in FIG. 2, is changed to that indicated by the broken line 122. The area of this interface 122 will be larger than that of the interface 104. This, the Applicant further believes, will also lead to reduced coal entrainment in the gas since the gas velocity at the interface will thereby be reduced.

Figure 4:
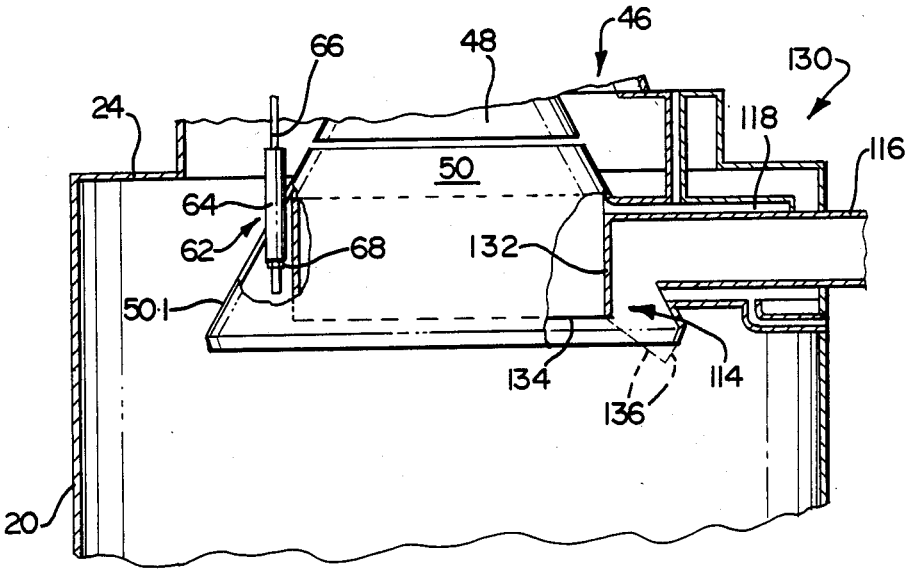
FIG. 4 shows, in part, a longitudinal sectional view of a fixed-bed dry-bottom coal gasifier according to still another embodiment of the invention, the second section of its second coal distributor being generally shown in full with parts thereof only cut away for clarity.

Referring to FIG. 4, reference numeral 130 generally indicates a fixed-bed dry-bottom coal gasifier according to yet another embodiment of the invention.

Parts of the gasifier 130 which are similar to those of the gasifier 110 hereinbefore described with reference to FIG. 3, are indicated with the same reference numerals.

It will be noted that the gasifier 130 is substantially the same as the gasifier 110, save that the skirt 112 of the gasifier 110 has been replaced by a skirt 132. The skirt 132 differs from the skirt 112 of the gasifier 110 in the following respects:

its cross-sectional shape is different to that of the skirt 112 in that it is of regular or constant diameter; however any other suitable cross-sectional shape (not shown) can also be used;

its bottom edge 134 does not depend as far downwardly as does the bottom edge of the skirt 112. The skirt 112 extends substantially to the same level as the bottom end of the section 50 of the distributor 46, whereas the lower end 134 of the skirt 132 terminates at a level somewhat above the lower end of the section 50.

The Applicant believes that the coal bed/gas interface, indicated by a broken line 136, will be as indicated in FIG. 4. Due to the increased area of the interface 136 as compared to the interface 104 (see FIG. 2), the gas velocity at the coal bed/gas interface is also reduced, and this should result in less carry-over of fine coal in the gas.

It is to be understood that the rotating or rotatable grate in the bottom of the chamber constitutes the discharge means for discharging the ash from the chamber into the ash discharge outlet.

What is claimed is:

1. A fixed bed dry bottom coal gasifier which includes a cylindrical wall proviing a fixed bed coal gasification chamber for gasifying coal to produce synthesis gas;

a coal lock above the chamber and having a coal discharge opening leading into the chamber;

a gas outlet leading from the chamber at a high level, a first static coal distributor located in the gasification chamber below the coal discharge opening of the coal lock, the first coal distributor having an upper opening spaced with vertical clearance from the coal discharge opening, a lower opening spaced from the upper opening, and an upwardly directed peripheral coal distributing surface flaring downwardly outwardly from said upper opening and extending beyond the vertical projection of the periphery defining the coal discharge opening; and a second static coal distributor located below the first coal distributor and spaced with clearance therefrom, the second coal distributor having an upper opening and a lower opening with its upper opening being spaced with vertical clearance from the lower opening of the first distributor, the second distributor also having a passageway extending from its upper opening to its lower opening through which coal can be distributed into the space below the first coal distributor.

2. A gasifier as claimed in claim 1, wherein the coal discharge opening of the coal lock is circular, and the first coal distributor is of hollow open-ended frustoconical shape with its smaller opening directed upwardly.

3. A gasifier as claimed in claim 2, wherein the diameter of the smaller opening of the first coal distributor is substantially the same as that of the coal discharge opening, and is aligned therewith, and wherein the gasifier includes a circular disc-like closure member movable downwardly from a first position in which it closes off the coal discharge opening of the coal lock to a second position in which it is spaced with clearance from said opening, so that coal can then be discharged from the coal lock, the closure member, in its second position, also closing off the smaller upper opening of the first distributor.

4. A gasifier as claimed in claim 2, wherein the second coal distributor is also of hollow open-ended frustoconical shape, with its smaller opening directed upwardly.

5. A gasifier as claimed in claim 4, wherein the diameter of the upper opening of the second distributor is smaller than the diameter of the bottom or larger opening of the first coal distributor.

6. A gasifier as claimed in claim 4, wherein the heights of the first and second coal distributors and their spacing from each other is such that the bottom of the second distributor is located below the coal bed level in the gasification chamber, and wherein the second coal distributor comprises an upper as well as a lower section located below the upper section, the first coal distributor being connected to the upper section, thereby locating the first distributor in position in the chamber.

7. A gasifier as claimed in claim 6, wherein the upper and lower sections of the second coal distributor are each attached to the wall of the chamber, the attachment of the lower section being effected by means of a plurality of attachment means extending between it and the wall, and these attachment means being spaced apart circumferentially about the lower section.

8. A gasifier as claimed in claim 6, which includes an annular skirt at the upper end of the chamber and located around the second coal distributor, the skirt depending downwardly from a portion of the gasification chamber wall which is at a higher level than the gas outlet, so that an annular gas-collecting zone is defined between the skirt and a lower portion of the gasification chamber wall, with the gas outlet leading through this lower portion of the wall.

9. A gasifier as claimed in claim 8, wherein the skirt, at or near its lower or bottom peripheral end, tapers downardly inwardly so that its diameter at its lower end is smaller than that at its upper end.

10. A gasifier as claimed in claim 6, which includes separating means separating the inside of the upper and/or lower sections of the second coal distributor into a coal-containing zone and a gas-collecting zone, the gas outlet then leading from the gas-collecting zone.

11. A gasifier as claimed in claim 10, wherein the separating means includes an annular skirt attached to and depending downwardly from the inner surface of the lower section of the second coal distributor so that the gas-collecting zone is an annular zone located between the skirt and that portion of the lower section of the second coal distributor located below the zone of attachment of the skirt to the lower section.

12. A gasifier as claimed in claim 11, wherein the gas outlet comprises a conduit extending through the portion of the lower section of the second coal distributor and through the wall of the gasification chamber, a water jacket being provided around at least a portion of this conduit.

13. A gasifier as claimed in claim 1, which includes a tar injection conduit leading through the chamber wall so that an outlet or discharge opening of the conduit is located within the first coal distributor.

14. A coal distribution device which includes a first frusto-conically shaped coal distributor;

a second frusto-conically shaped coal distributor aligned with the first coal distributor so that the distributors are located along a common axis with the smaller opening of the second distributor facing the larger opening of the first coal distributor and spaced axially therefrom, and with the distributors being arranged in non-overlapping relationship, the diameter of the smaller opening of the distributor being less than that of the larger opening of the first distributor, and the diameter of the larger opening of the second distributor being greater than that of the larger opening of the first distributor, the first and second distributors constituting coal distribution means;

connecting means fixedly interconnecting the distributors so that the distributors are held immovable relative to each other; and attachment means for attaching the coal distribution means inside a chamber.

* * * * *